US005887864A

United States Patent [19]

Stevens et al.

[11] Patent Number: 5,887,864

[45] Date of Patent: Mar. 30, 1999

[54] METHOD OF AND APPARATUS FOR PROCESSING AND STACKING PRINTED FORMS

[76] Inventors: Kenneth A. Stevens, 1099 Atlantic Dr., #2, West Chicago, Ill. 60185; Douglas J. Keller, 81 Rose St., Farmingdale, N.Y. 11735

[21] Appl. No.: 697,441

[22] Filed: Aug. 23, 1996

Related U.S. Application Data

[60] Provisional application No. 60/004,380 Sep. 27, 1995, and provisional application No. 60/004,370 Sep. 27, 1995 and provisional application No. 60/005,820 Oct. 23, 1995.

[51] Int. Cl.[6] ..... B65H 39/00

[52] U.S. Cl. ..... 270/52.07; 270/58.07; 270/58.27

[58] Field of Search ..... 270/58.01, 58.07, 270/58.04, 58.27, 52.07, 57.09

[56] References Cited

U.S. PATENT DOCUMENTS

| | | | |
|---|---|---|---|
| 1,738,119 | 12/1929 | Sague . | |
| 4,171,127 | 10/1979 | Kish et al. | 270/58.27 |
| 4,273,319 | 6/1981 | Stocker | 270/21.1 |
| 4,456,127 | 6/1984 | Hams | 209/564 |
| 4,572,497 | 2/1986 | Drescher et al. | 270/58 |
| 4,746,109 | 5/1988 | Bar et al. | 270/52.09 |
| 5,348,278 | 9/1994 | Ring | 270/52.07 |

*Primary Examiner*—Hoang Nguyen
*Attorney, Agent, or Firm*—Lee, Mann, Smith, McWilliams, Sweeney & Ohlson

[57] ABSTRACT

A method of and apparatus for processing and stacking printed forms operatively connects three main features. First, a dual registering stacking interface that stages, registers, transports, justifies and stacks forms in which forms are delivered to a side-by-side holding area known as channels one and two, where they are held stationary and accumulate in a stack or continue feeding as separate forms. Second, a sequencer merger receives the forms from the dual registering stacking interface and dual registering stacking interface and directs the forms in a selected order and transports said forms to its output end as a stack of forms. Third, an improved access accumulator incorporates the physical separation of upper from lower transport belt assemblies. A separate upper transport assembly is installed using ball bearings as hinges on the existing upper output shaft, spring loaded ball stud latches are used to latch the upper assembly to the lower assembly via two alignment blocks on either side of the device. Spring loaded latches provide the capability to pass multiple stacked pages into the device at one time thus allowing more than one page to pass into the stack together.

16 Claims, 14 Drawing Sheets

302
303
304
305
306
307
308
309
310
311
312
313
60
190
192
194
196
198
200
202
204

METHOD OF AND APPARATUS FOR PROCESSING AND STACKING PRINTED FORMS

RELATED APPLICATIONS

This application incorporates by reference the disclosures in Provisional Applications, Ser. No. 60/004,380, entitled "Dual Registering Stacking Interface" and Ser. No. 60/004,379 entitled "Improved Access Accumulator" filed Sep. 27, 1995, and Application Ser. No. 60/005,820, Filed Oct. 23, 1995 entitled "Method of Processing and Stacking Printed Forms."

BACKGROUND OF THE INVENTION

The invention relates to a method of and apparatus for handling both preprinted and unprinted forms. Forms which are preprinted and coded in certain machine or human readable formats may be taken from a bulk stack or roll of forms and automatically processed. Unprinted forms can be processed using preprogrammed steps.

The processing operations may include combinations of stacking, sequencing, merging, accumulating, restacking, folding and then loading into a high speed mail insertion machine. The invention can be operated both in line—with an inserter—or off line for testing or other operations such as sequencing and stacking for folding. The stacked, folded forms can then be handled manually or preferably fed to an inserter machine. These can also be programmed in a preset automatic non-optical mode that does not rely on optical marks for control.

The invention has advantages in a combination of its flexibility in handling alternative form printing formats such as last page first, mixed multiple and independent sequencing and stacking, as well as keeping track of multiple page and variable page sets while also providing greatly improved speed of operation to enable maximizing the speed of the high speed mail insertion machinery.

Prior art feeding and transporting mechanisms require major mechanical and electronic changes to efficiently process a variety of form sizes and formats and printing sequence formats. Most prior art devices have no provisions for under or over stacking while running a side-by-side form. In addition, most prior art devices make no provision to stack, right and/or left justify and deliver up to two channels of paper side-by-side, independently of each other, with precise superimposition of the stack.

At this time the method of operation needs to be understood. As described above, there are a variety of formats for printing of documents that arrive to the envelope inserter facility in the form of the continuous form web. For a variety of reasons, web is printed at the convenience of the company whose statements or mailings are typically to go to mail recipients. Often this is a company such as a credit card company sending credit card bills or a bank sending mortgage statements or the like.

Very often, the preprinted webs of continuous feed forms are delivered to a mailing house that processes and mails all the documents with the capital, facilities and expertise to do so with greater efficiency than the credit card companies or banks. However to serve different credit card companies, banks or the like, it is necessary for the mailing house to tailor its operations to process using whatever format their customers, the different credit card companies, banks or the like use. Since the different credit card companies, banks or the like often print in different formats, flexibility in processing formats is important to the efficiency of the mailing house. Similarly, even a mailer who does the envelope insertion itself may want to have flexibility in the event it changes its printing program or uses different printing programs.

Formats such as "one up" printing, where a single page is processed are fairly easy to feed into an envelope inserter such as that taught in U.S. Pat. No. 1,738,119 and later embodiments generally known as machines of the Phillipsburg type. For documents feed "two up", typically side by side, it is necessary to use a merger so that a plurality of document streams or channels result in a single channel. A typical approach is that taught U.S. Pat. No. 4,273,319. Another approach is in U.S. Pat. No. 4,572,497. Still another is taught in U.S. Pat. No. 4,456,127. None of these, however, appear to be adaptable to handle all the variations that may be handled by the instant invention. The foregoing patents are incorporated by reference.

West/East printing starts with the left channel 48, the next page to the same recipient in the right channel, the third page back to the left channel, but, of course behind the first page. This sequence, zig-zagging back and forth, is repeated for the selected number of recipients and pages. When there are the same number of pages for every recipient, the format is called "West/East multiple." Where there is a different number of pages for every recipient, the format is called "West/East mixed multiple." If the right channel has the first page and the left channel the second, the analogous terminology to that above would be used to describe "East/West" formats. Typically, documents fed in West/East or East/West are accumulated in a stack in an accumulator and then the set is injected to a folder and thence to the inserter. However, the foregoing arrangements in the typical inserter feed arrangements known in the prior art are unable to handle North/South multiple formats. North/South mixed multiple format and the operation of the invention will be discussed in detail and with reference to schematic drawings.

Thus, the convention in the high speed printing and the subsequent high speed mail handling field is to refer to printing operations as "East/West" where related forms such as a credit card bill of multiple pages that go to the same addressee, are printed, at least in part, side by side, and "North/South" where related forms are printed end to end or top to bottom. Another convention is to refer to form printing and subsequent high speed mail handling as "one up" where a single page is printed, and all subsequent pages follow in one continuous feed batch, and "two up" where two pages are printed side by side and enter the high speed mail handling equipment's first step (usually a cutter) in a side by side manner. It is the forms, as printed, which determine whether the batch is arranged "East/West", West/East, "North/South".

When forms are printed and have different number of pages per set they are referred to as mixed multiple forms. While these may be printed either "East/West" or "North/South," because of the mixed number of multiple pages, it is critical to control both channels to be sure sets are processed correctly. East/West or West/East mixed multiple forms use both left and right channels to process one particular form, effectively zig-zagging from one channel to the other. North/South mixed multiples have all the pages for one form in one channel, but both channels must be controlled to be sure multiple forms from one channel are not processed out of order relative to the other channel.

A one-up continuous form is a continuous web of paper used for creating documents in a continuous stream allowing only one document for the width of the form. Each consecutive document appears in a subsequent pattern and continue along the length of the web.

A two-up continuous form is a continuous web of paper used for creating documents in a continuous stream allowing two documents to be printed side-by-side restricted by the width of the form. This form is generally slit vertically down the center to separate the documents and then trimmed to width on the sides.

North/South printing sequence format is a process by which a one-up or two-up continuous form is used, printing one document or two documents side-by-side. Of course, by definition one up forms have to be North/South because there is no East/West relationship.

East/West printing sequence is the process by which a two-up continuous form is used for printing two documents side-by-side on a continuous web. In East/West, when a multiple page statement is required, the first page of the set can appear in channel one or channel two (left or right). The next page of that same set would appear in the next position using a left to right, top to bottom theory of collation. Therefore, if there was a three page set and page one of that set appeared in channel two, the second page appeared in channel one, one position down from the first page and the last page of that set would also appear in channel two, one position down from the first page. The convention used herein will use West/East by analogy to the cardinal points of a compass where North refers to the leading edge of the sheet. Thus, West/East refers to side by side pages with the left page first, while East/West refers to side by side pages with the right page first.

Other known prior art uses single track form feeders and cutters feeding accumulators and sequencers. These single track accumulators do not permit the handling of two up mixed multiple forms. These also have limitations in handling certain East/West, North/South and mixed multiple formats. The prior art cannot select between printing the aforementioned modes alternatively, or with simple program changes. Further, the use of a controllable dual registering stacking interface can nearly double the ultimate speed of operation because of the ability to sequence two-up printed forms. The physical feed and sequencing of the original batch of printed forms are often limiting factors in machine operation speed.

Prior art feed arrangements generally simply use a fixed format cutting and inserting virtually straight from the computer printed continuous feed forms. While this prior art is adequate for processing repetitive routine jobs, there is a complete lack of flexibility in adapting to different continuous feed form formats.

Most forms are fed using industry standard optically readable coding marks to identify related forms. In the invention, these are fed through a forms cutter or perforated form burster which physically separates the continuous feed computer printed batch of forms into an "East/West" set of papers. In the typical usage, a single web of multiple pages is processed through a cutter or burster which includes the optical reading apparatus. This set of papers is then fed into a dual registering stacking interface.

It will be understood that in the industry different formats and sizes are used. The main advantage of the invention is that it can be adapted to varying formats of single pages, left and right pages, mixing of the number of pages in a given mailing and the like, as will be described.

The dual registering stacking interface or "register" enables an improved method of processing cut forms originating from a stacked continuous web of paper and flexibility in processing all of the required printing sequence formats.

The prior art includes a register table. This outer-edge justifies, or registers, two-up pages, but does not stack. Register tables have been used for different West/East or East/West applications and North/South single page sets, but cannot process North/South multiple page sets.

Two separate forms are delivered side-by-side and enter the register. The separate forms are fed into first and second parallel staging areas respectively. While the forms are in these staging areas optical characters previously read on the forms are processed and the forms composed for delivery to the stacking area. Optionally, appropriate reader apparatus could be incorporated with the register.

Moving to the stacking area, where multiple page sets are involved, the pages are stacked respectively separately and progressively right and left justified prior to releasing to a subsequent device—the sequencer-merger. The pages are also lead edge justified and become superimposed.

Where single pages are involved, the dual registering stacking interface functions as a North/South area enabling timing for sequencing. Justification remains important for maximum speed and the control provided enables better sequencing.

A key to this operation is the processing of the optical reading to determine the relatedness of forms in selected combinations of North/South series or East/West relationship. Thus, the processing of the optical reading will determine the need for collation, the need for incorporating related pages into sets such as in East/West mixed multiple forms, the sequencing of sets or simply the sequencing of single page printed forms. Even in this last operation, control is desirable where, for example the printing in Zip code order proceeds with the left hand ("West") form first or the right hand ("East") form first. Indeed, the invention permits a more flexible terminology because the invention can control West/East forms as well as East/West forms—a distinction not heretofore permitted with any known automated machine.

It should be recognized, however that the invention can also be used in a preprogrammed sequence and/or set collation without using reading. Examples of this operation would be where there is so little variation in the forms that sequencing need not be automated, or even where the apparatus is used for a purpose other than mailing such as sequencing and feeding hand deliverable materials to a folder in an off line manner. The prior art has not generally been adapted to off line operation.

In the preferred embodiment, appropriate automatic actuator controls will signal whether, for example, a second page in one channel relates to the immediately prior sheet (now in the stacking area). If related, the two will be stacked. If not, then each sheet will be injected to the next step.

The sheet or stack is released and moved from the stacking area after a predetermined number of forms have accumulated in said stack. Each channel's moving mechanism includes upper and lower transport belts transversely offset from each other which are in different vertically adjacent planes to cause the belts to grasp and move the forms forward. These belts are also in different horizontally adjacent planes.

Preferably each set of belts for a given channel are horizontally angled to the outside as paper travels to the right on channel two, to the left on channel one. This causes a sheet and consecutive forms to be accumulated and right or left justified and are neatly stacked prior to release from the stacking area in either channel. At a minimum one set, preferably the outer set, would be angled.

Each stacking area is located between a sheet recording mechanism to record the number of forms passing through and a pair of spring loaded compliant rollers. The rollers stop the paper stack from moving forward, align said stack perpendicular and square with the next device and eject said stack to a subsequent process. Stacking is assisted by low friction sheaves through which the belts pass, but which enable subsequent forms to pass under earlier forms maintained in the North/South area. Generally the friction of the belts prevents any rebounding of the forms. There is no rear stop needed.

In order to accomplish registering, the present invention provides implementation of the transversely offset upper and lower belts and with their driven rollers horizontally offset and adjusted about 5 degrees offset from their drive rollers toward the right or left side of the device for right or left justification, stacking and superimposing. The angle is variable for maximum performance with different forms, paper, speeds and the like and has been effective between about one degree to about 10 degrees. A separate left hand and right hand clutch/brake control is provided for each left and right channel for independent or simultaneous release to a subsequent process.

The dual registering stacking interface is adaptable to selectively handle the following different combinations of form layouts: one-up continuous form; a two-up continuous form; East/West printing sequence format and North/South printing sequence format, left channel first or right channel first.

Collation in the North/South printing sequence format mode is done in the register stacking area(s) and before sequencing. In the East/West format collation of sets is done in the accumulator/collector after sequencing.

In North/South when a multiple page document is required, the first page of the set will appear in the first position on a one-up form and each consecutive page thereafter. In a two-up form, the first page can appear in either of two side-by-side channels and each consecutive page will appear in the next position after its previous page using a top to bottom theory of collation for either of the two channels.

The dual registering stacking interface or register positively registers the forms outwardly against rails as they pass from a staging area to a stacking area. The previously read coding is processed and the stacking controlled so that the desired collation is accomplished. This can, for example, be simply west/east programming where each of two related papers which travel side-by-side are intended to be collated and to be ultimately inserted together in a single envelope to a single customer. West/east forms feed into the sequencer/merger are fairly easy to control because the forms are in the proper order when they enter the sequencer/merger and thence enter the improved access accumulator. In the prior art, this could also be accomplished with a register table, which was not a multiple function unit like the register.

The use of the register in conjunction with the other steps described herein also enable highly complex collation and sequencing such as North/South mixed multiple stacking as where the identity between sequential papers is on a North/South basis but not all customers receive the same number of pages in their mailing. Thus, with two pages in the registered area and two pages in the stacking area, three separate customers may be represented. The north/east customer may get a single page, the north/west customer may get two pages comprising the north/west page and the south/west page, while the south/east page is for yet a third customer.

The stacking mechanism in conjunction with the optical reader and control will then inject stacks in the proper order into the sequencer merger.

The sequencer merger includes deflector guides fixed at both ends which both invert and rotate each stack. They are inverted 180 degrees (180) vertically and rotated 90 degrees (90) horizontally in the preferred embodiment. From here, the now sequenced stacks are injected into a transport, collector, or subsequent device such as an one up stacking register which performs a task of counting and controlling each individual stack. When an online one up stacking register is used, for example, it then injects each stack in the proper order into a folder and thence into the high speed mail inserting machine. In the prior art, the sequenced forms are always merged, or overlapped. In the invention, the ability to change the timing or release of the forms will enable the forms to be fed in a non-merged or separate manner where desired.

For maximum flexibility in in-line operations, an one up stacking register is a transport assembly for a paper feeding mechanism. Prior art accumulators have upper and lower transport belts transversely offset from one another, but in line with the centerline of the one up stacking register, used to transport paper and/or stack paper. These have no provisions for removal of paper from the device once caught between transport belts when stationary. Currently it is difficult to remove a piece of paper easily and without damage. It is also difficult to install a piece of paper manually or to inspect. In addition, current designs have no provisions for compensating for more than one stacked page to enter the device at one time.

For improved precision and efficiency, the stacking register of the invention can be used for one-up operation as well as for two-up operations. As with the dual registering stacking interface the one to ten (preferably 5) degree angle side justifies the forms.

OBJECTS OF THE INVENTION

The present invention overcomes these drawbacks and has for one of its objectives the provision of a transporting mechanism which requires minimal operator intervention during changeover between applications.

An object of the present invention is the provision of the use of the belt transports to right and left justify accumulated forms into orderly and precise superimposed stacks.

Another object of the invention is to independently control the release of accumulated forms from one of two channels into a subsequent device.

Yet another object is to allow the processing of North/South or East/West printing sequence formats and one-up and two-up continuous form formats with a single device and bottom or top stacking the same.

The present improved access accumulator overcomes these drawbacks by providing a way by which a person can easily access a piece of paper from a feeding device captured between upper and lower transport belts transversely offset for feeding paper thereby making the piece of paper difficult to remove or install without damage and in an expedient manner.

One object of the improved access accumulator is the provision for a hinged upper transport assembly which will allow access to the piece of paper normally caught between the upper and lower transport belt assemblies.

Another object of the improved access accumulator is to allow for several stacked pages to enter the device together with unwanted incremental pull or unwanted skew. This is accomplished with the use of adjustable alignment blocks for vertical adjustment of the upper transport belt assembly along with spring loaded latches securing the upper transport belt assembly in alignment with the lower transport assembly with some flexibility allowing the multiple page sets to be accepted.

Other and further objects of the invention will be apparent upon an understanding of the illustrative embodiment about to be described, or will be indicated in the appended claims and various advantages not referred to herein will occur to one skilled in the art upon employment of the invention in practice and the scope of the invention is not to be narrowed by these statements of objects.

BRIEF DESCRIPTION OF THE DRAWINGS

FIG. 6C is a sectional view of the top improved access accumulator.

DETAILED DESCRIPTION OF THE DRAWINGS

Figure 1:
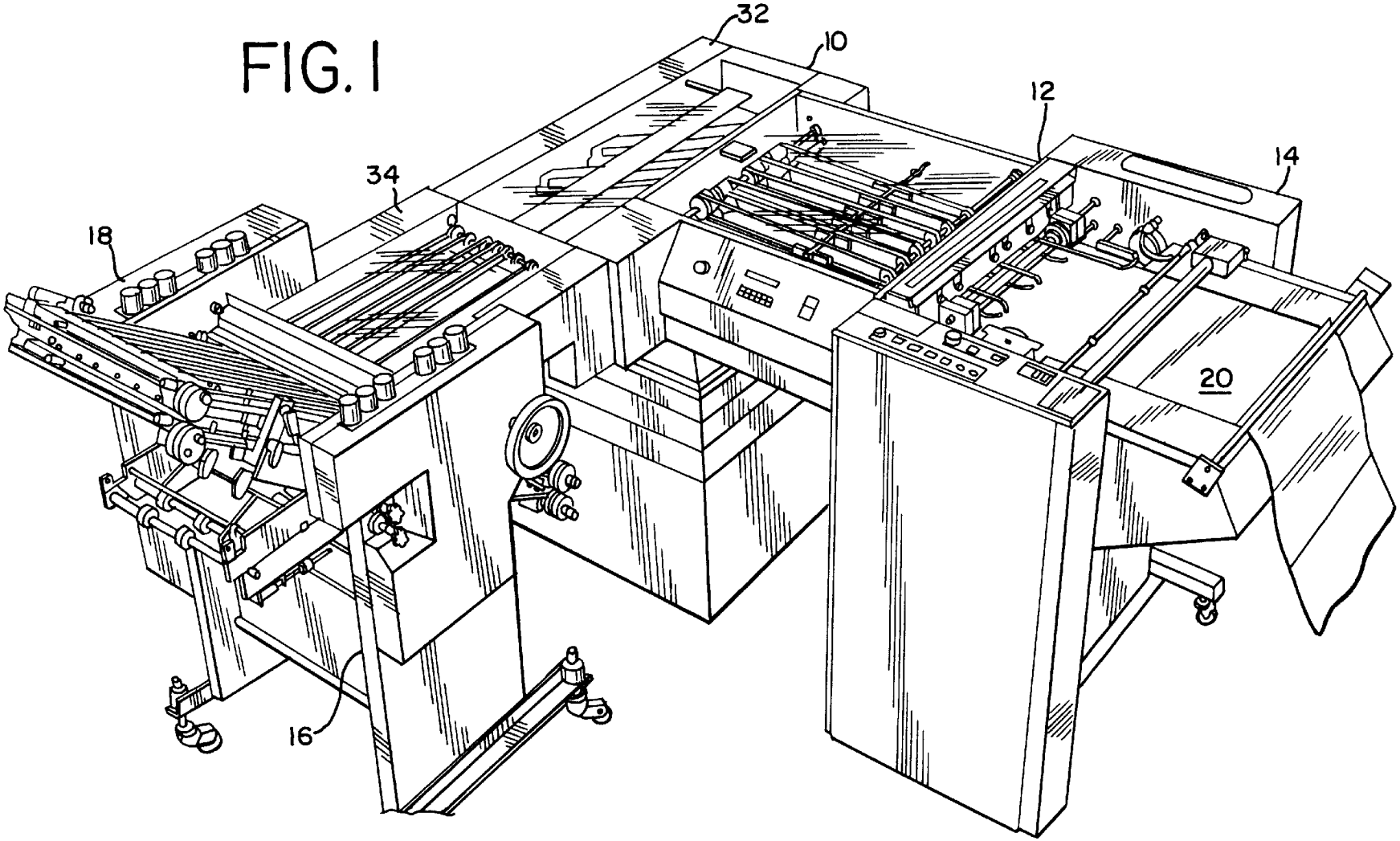
FIG. 1 is a perspective view showing the general layout of the apparatus used in practicing the method.

The invention generally comprises a method using a three component feed assembly 10 operatively connected at an input end 12 to forms cutter 14 and at the output end 16 to a folder 18.

In operation, a stacked or roll fed continuous web 20 of preprinted forms feeds into forms cutter 14. An individual form feed web 22 will be cut into left form 24 and right page 26 as they feed into the forms cutter 14. From forms cutter 14 the cut pages 24 and 26 are injected into dual registering stacking interface 30.

The key components in this apparatus are a dual registering stacking interface or register 30, an improved high speed sequencer merger 32 and an improved access accumulator 34.

Referring to FIG. 2A, 2B, 6B, 11 and 12 the transport assembly of the dual registering stacking interface has a number of lower belts 40 activated by lower pulleys 42 and a number of cooperating upper belts 44 activated by upper pulleys 46 which are transversely offset from the lower pulleys and also angularly offset relative to the longitudinal axis of each paper path.

Web 20 cut into individual pages 24 and 26 enter left channels 48 and right channel 50 respectively between upper and lower belts 40, 44. Pages 24, 26 then move into Staging areas 52 and 54 waiting for a command signal to allow the input device to release said paper to be transported to stacking areas 56 and 58. As paper travels from staging areas 52 and 54 to stacking areas 56 and 58 it is transported outboard and left and right justified towards left hand side guides 60 and right hand side guides 62. Due to the lower and upper transport belts of both channels being horizontally offset to the outside and toward guides 60 and 62 due to the lower and upper transport belts of both channels being horizontally offset to the outside and toward guides 60 and 62. This allows for a left or right justified stack occurring in stacking areas 56 and 58. Additional pages will follow, stacking on the previous pages right or left justified against side guides or rails 60 and 62 neatly stacked and superimposed square to output rollers 64 and 66. Prior to release to a subsequent device, paper is now stacked in each stacking area 58, 60 up to a predetermined number at the time the control system decides which channel to move, and at what time.

FIG. 19–23 illustrate the way the invention can process North/South Mixed Multiple format documents with greatly improved speed and efficiency. While other document format combinations have been capable of processing at high speeds primarily using a single accumulator as the stacking apparatus, such as West/East and East/West in multiple and mixed multiple arrangements, and North/South in fixed number sets, processing North/South format documents when they are in sets of mixed numbers, e.g. one set with two pages, the next with three pages, the next with a single page, have been problematic. This is because a set with a fewer number of pages would finish before a set with a greater number in passing through to the sequencer/merger thereby throwing out of order the pages of following sets.

Figure 19:
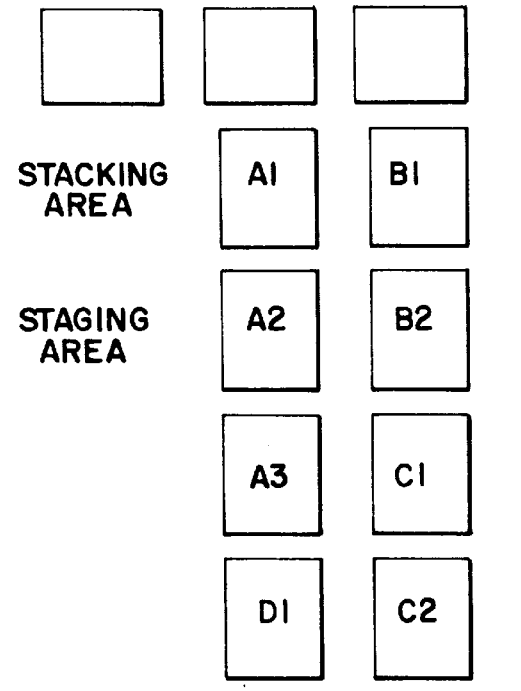
FIG. 19 schematically illustrates North/South mixed multiple printed documents at a first stage.

FIG. 19–23 illustrate a method of processing printed papers in a schematic form. The left channel 48 and right channel 50 feed into registering or staging areas 52 and 54 stacking areas 56 and 58. In these schematics the letter designations "A", "B", "C" and the like have been used to designate associated sets, such as credit card bills to be mailed to one addressee, while the numbers following the letters designate the page number. Thus, the three pages of papers coded to addressee "A" are pages A1, A2 and A3, the two pages to addressee "B" are pages B1 and B2 and the like. FIG. 19 begins at the time that the first form enter stacking areas 56 and 58.

Figure 20:
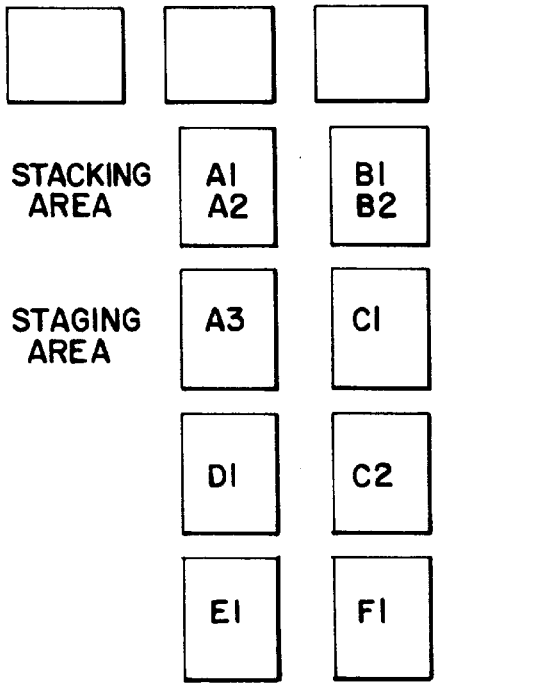
FIG. 20 schematically illustrates North/South mixed multiple printed documents at a second stage.

In FIG. 20 both the A and B sets are being stacked in areas 56 and 58. These are represented by the convention of showing the alphanumeric designations A1 over A2 and B1 over B2, respectively, which convention will be used for the other sets as well. Since the B set has fewer pages than the A set, it is completed first and moves out of area 58 into sequencer/merger in FIG. 21.

Figure 21:
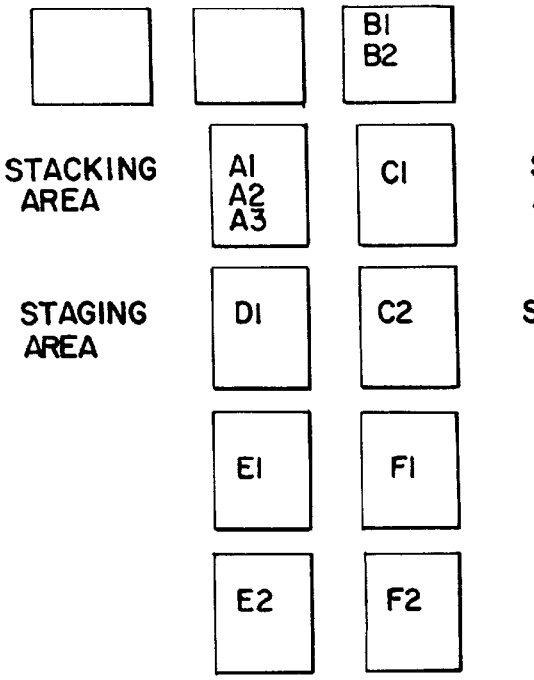
FIG. 21 schematically illustrates North/South mixed multiple printed documents at a third stage.

In FIG. 21, the A set has three pages, and is still stacking in area 56 while the B set, having only two pages has already passed into the sequencer/merger. If there were no stacking in the register, both forms sets would be passing into the sequencer merger, thereby potentially commingling the B set, completed ahead of the A set, with the A set which has three pages.

Figure 22:
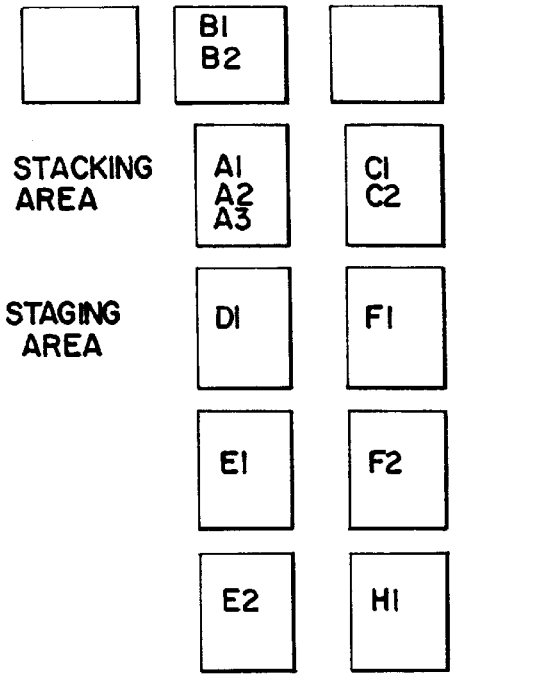
FIG. 22 schematically illustrates North/South mixed multiple printed documents at a fourth stage.

FIG. 22 shows that when set A is complete, is not yet released to the sequencer/merger because the B set needs to pass completely through the sequencer/merger. Set B is shown as leading set A. This is anticipated in the printing operation, not a part of this invention, so that, for example, the sets are printed to be collated and processed in the correct zip code order.

Figure 23:
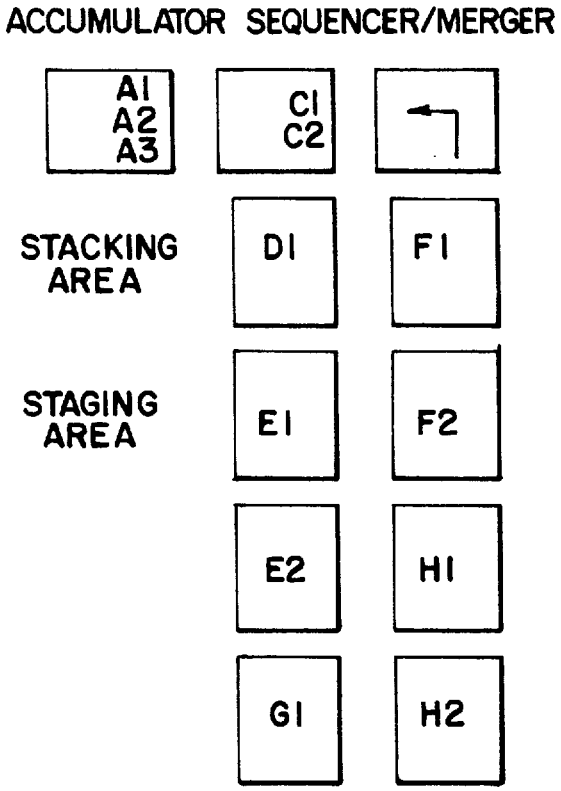
FIG. 23 schematically illustrates North/South mixed multiple printed documents at a fifth stage.
Figure 3:
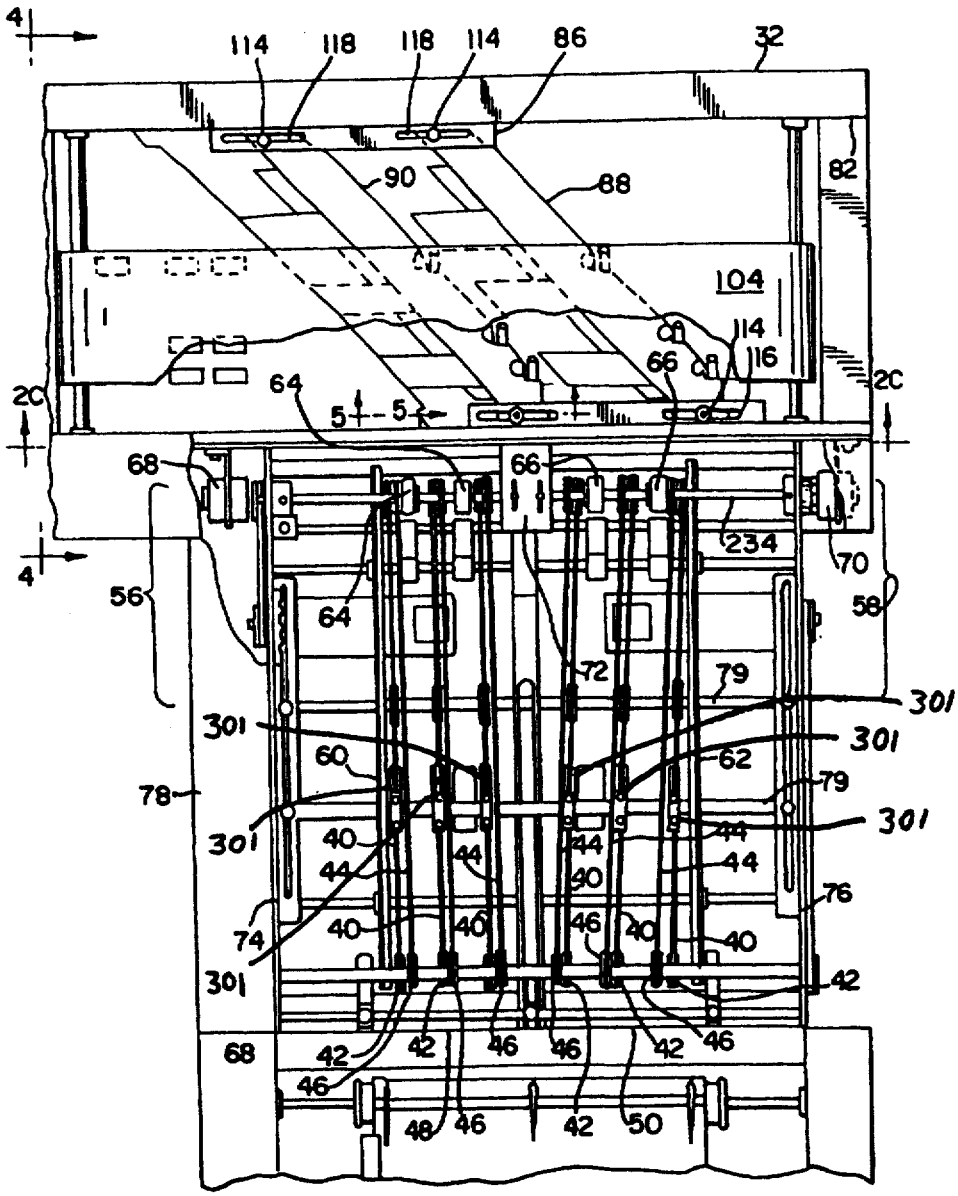
Figure 19:
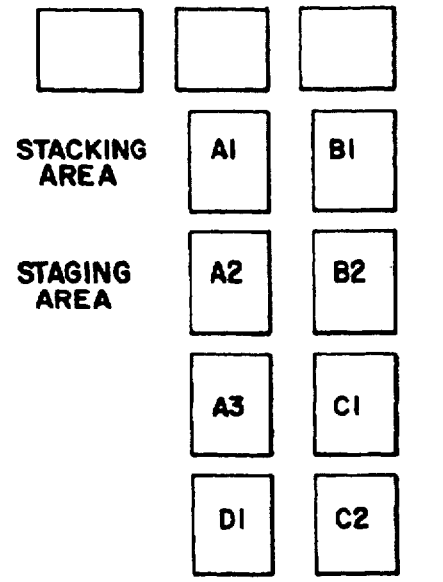
Figure 20:
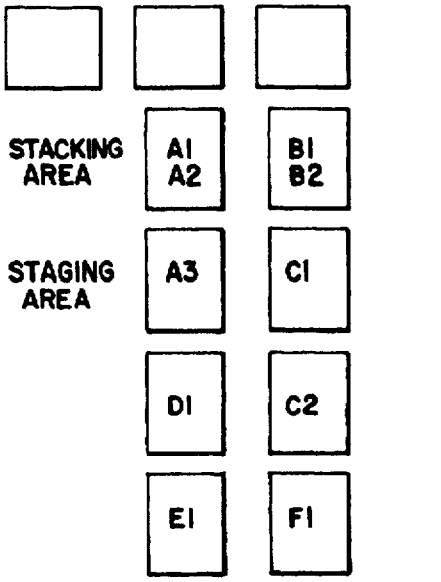
Figure 21:
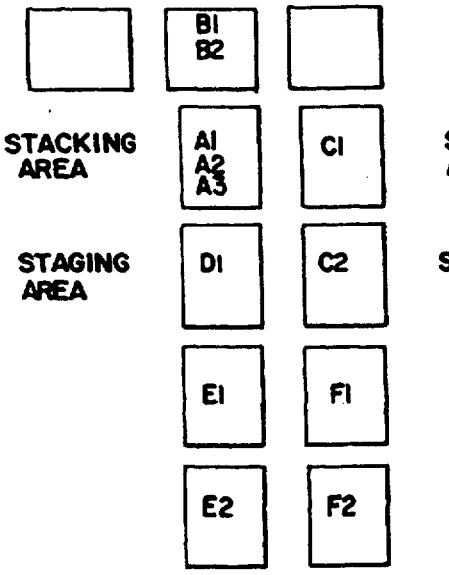
Figure 22:
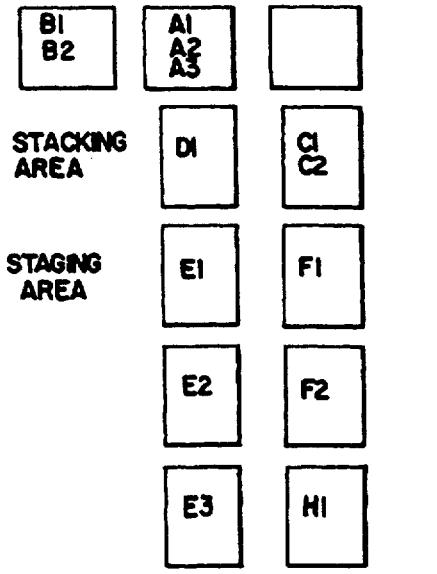
Figure 23:
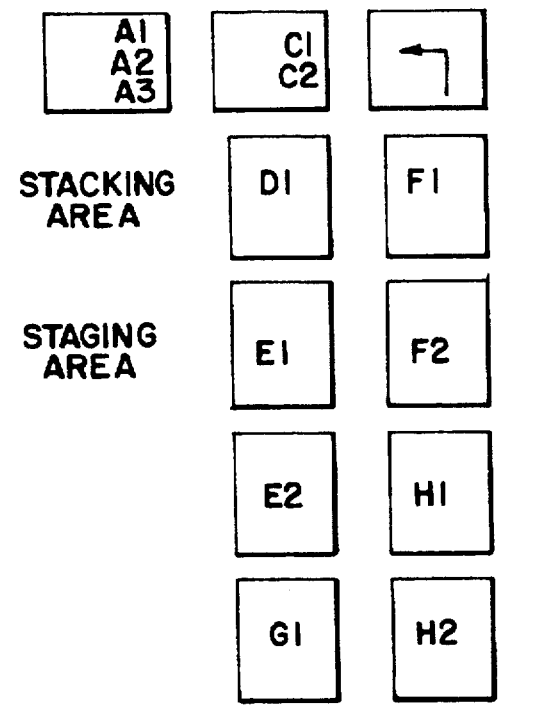

The precise timing, in fractions of seconds, is indicated by the arrows in FIG. 21–23 schematic, there being sufficient lag to anticipate set B accumulating as shown in FIG. 23. In FIG. 22, it may be seen that set C has completed stacking in moving out of area 58.

FIG. 22 shows set A, now complete, passing into the sequencer/merger. Set C is also released into the first position in the sequencer/merger. One page set D has been held in stacking area 56 and will do so until set C clears in FIG. 24 the sequencer merger to enable set D to pass through in future steps. The ability to control the release of channels 48 or 50 to the sequencer/merger is therefore a key to this operation of the invention.

Preferably, North/South fixed number multiples are also stacked in areas 56, 58. While North/South single pages could be done with the prior art register table and the register table could be used for all West/East and East/West combinations, the register table could not perform the North/South multiple operations.

Since both left and right channels are independent of each other, moving either channel of paper can be accomplished at one time, clutch and brake assemblies 68 and 70 are used to rotate the output rollers or feed wheels 64 and which in turn will move the stacked paper into the next device.

The angled offset of the belts 40, 44 justifying the paper outwardly against side guides or rails 60, 62 provides greatly improved speed and accuracy. High speed form cutters are not sufficiently accurate that all paper widths are within particularly close tolerances. Using the outward justification therefore is a major improvement.

Sequencer merger 32 is shown in FIGS. 3–5, 15–16. Side plates 80 and 82 support a generally box—like structure. Angle supports 84, 86 support tube assemblies 88 and 90. An aperture is formed in plate 80 to permit passage of paper forms from register 30, which is mounted to plate 80.

Tube assemblies 88, 90 are made up a crosspiece 92, inner tube section 94 spacers 96 and outer tube section 98. Each tube section 96, 98 has a respective extending flange 100, 102 which receive a form 24 or 26 ejected from register 30 and turns it 180 degrees vertically—turning in "upside down" in the preferred embodiment.

Because tube assemblies 88, 90 are angled 45 degrees to the direction of ejection from register 30, the forms are also rotated 90 degrees horizontally. Belt 104 driven by drum 106 on drive shaft 110 by motor 112 carry forms longitudinally to the improved access accumulator, or accumulator 34 at the exit end of the sequencer merger.

Mounting screws 114 firmly hold assemblies 88, 90 to supports 84, 86 enabling precise adjustment thereby improving reliability at high speeds of operation. Adjustment slots 116, 118 permit fine running of the angle of assemblies 88, 90. Slot 118 can preferably be adapted to have a slightly wider slot than that on support 84 to permit both skew adjustment and longitudinal adjustment of tube assemblies 88 and 90.

Mounted on exit flanges 120 of inner tube 94 are lower bearings 122. Mounted to crosspiece 92 are tensionable upper bearings 124 carried on adjustment arm 126 which may have spring tension selectively adjusted using adjustment screw 128. It has been determined that as paper skew is adjusted, tension across the rollers can be differentially adjusted for better control of paper direction.

These improved sequencer/merger tube assemblies 88, 90 are particularly useful in handling forms that may be injected to the sequencer/merger 32 from the register 30 in a stacked condition. Prior art sequencer/mergers were primarily designed to sequence and stacked condition. Prior art sequencer/mergers were primarily designed to sequence and merge single forms or sheets, typically from a variation on a West/East printing format. However, these were prone to jamming, damage to the forms, slowing of the operations or other drawbacks when the feeding of stacked forms, such as in North/South multiple or mixed multiple formats from the dual registering stacking interface or register 30. The increased range of adjustment, clearance and guiding of papers in all three dimensions using the combination of tube configuration, adjustable rollers 124, 122, various flanges 100, 102, 120 and adjustment for the tubes in the sequencer/merger 32 enables handling simultaneous passage of stacked forms with comparative ease. Of course, this wide range of adjustments also enables better and therefore faster, more efficient, handling of single forms.

Figure 6A:
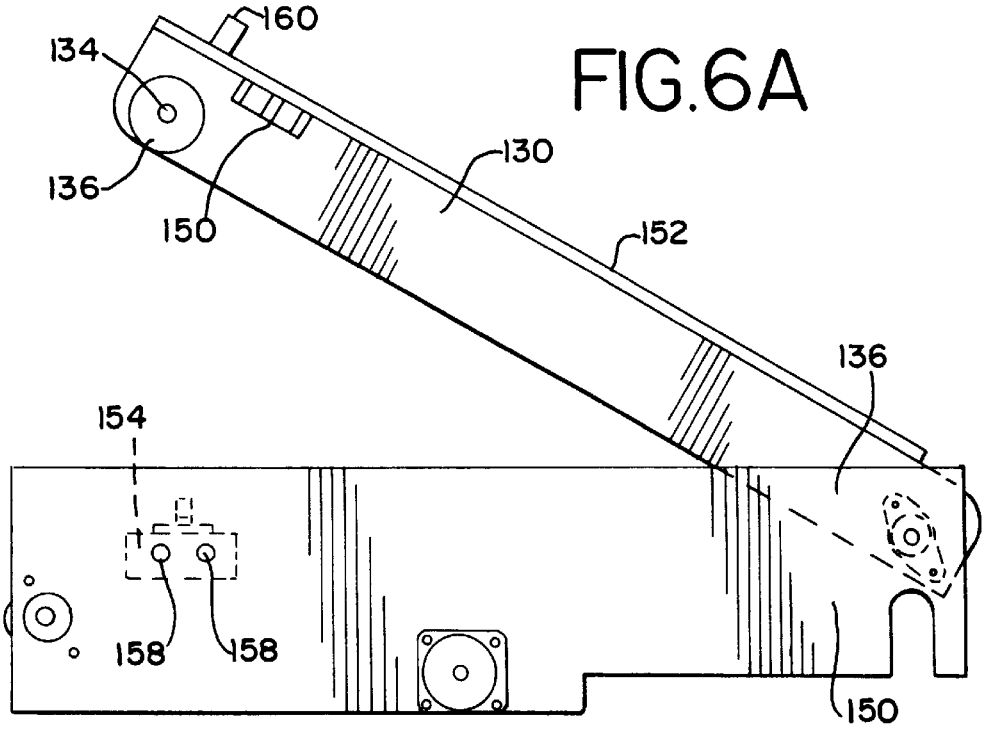
FIG. 6A is a side elevational view of the improved access accumulator.
Figure 6:
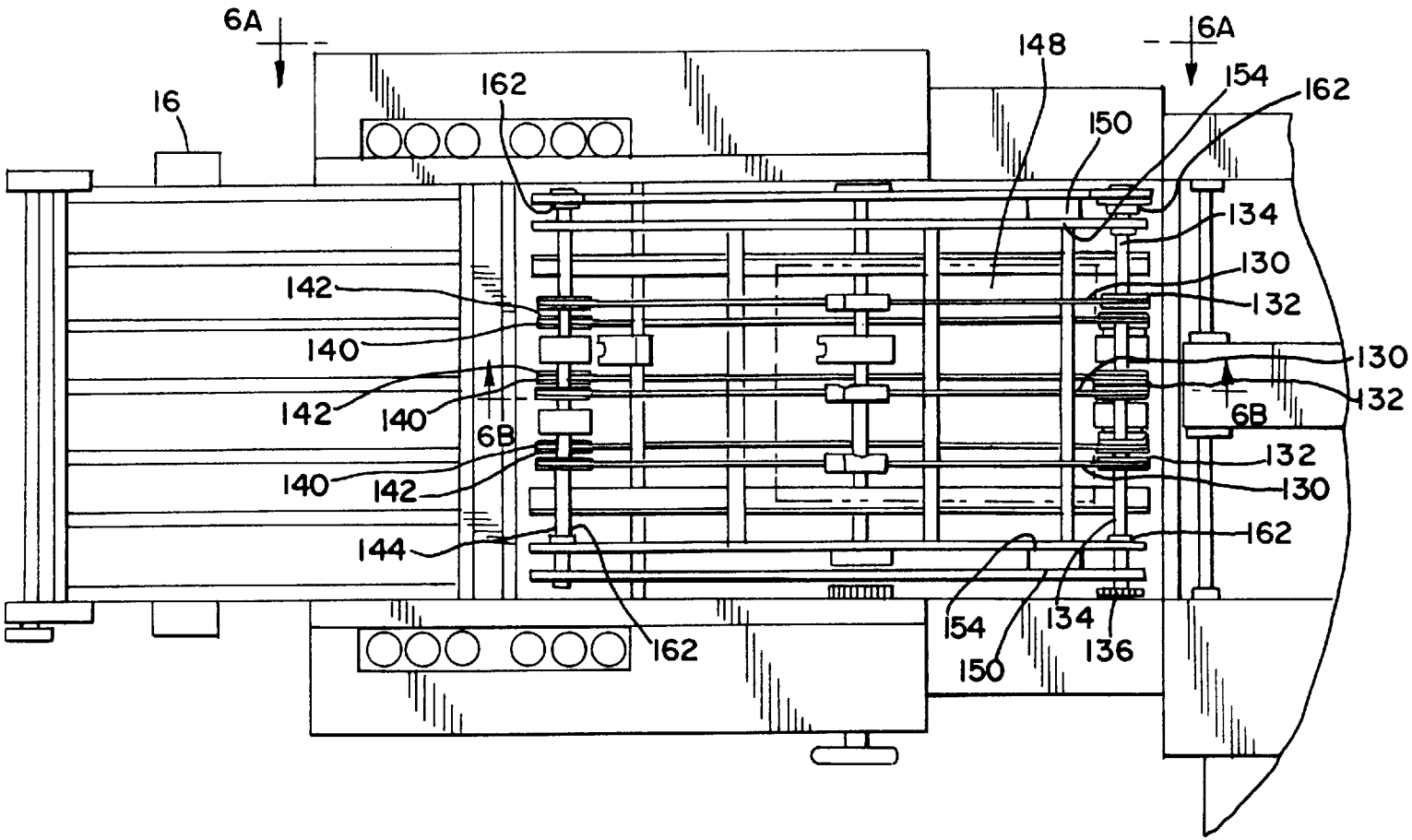
FIG. 6 is a plan view of the improved access accumulator.
Figure 6B:
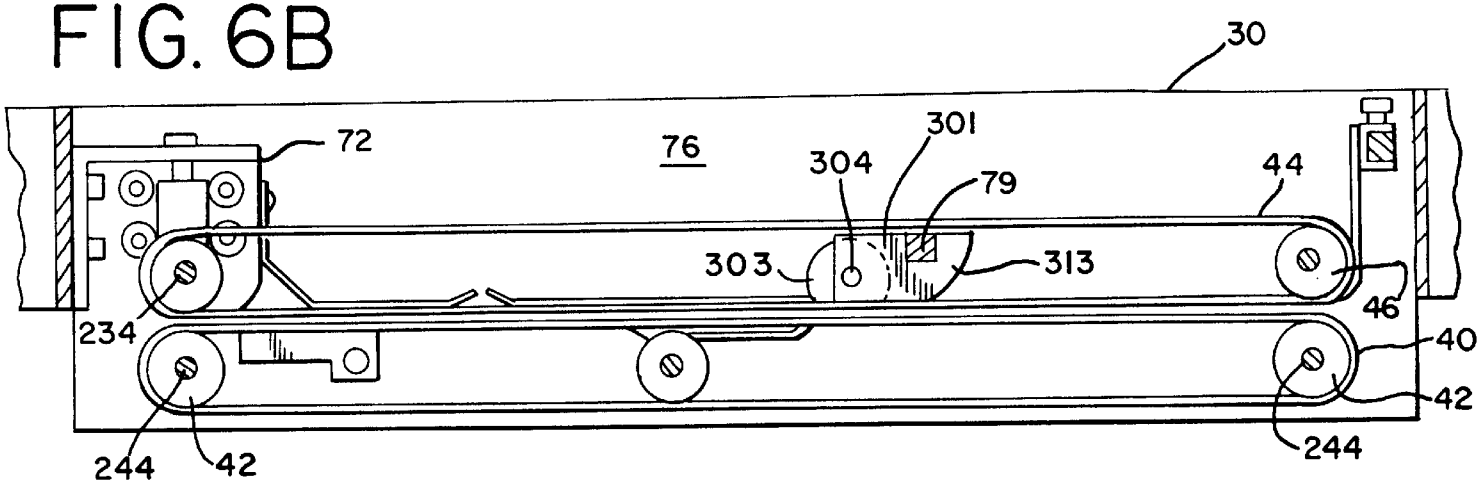
FIG. 6B is a sectional view of the dual registering stacking interface.
Figure 7:
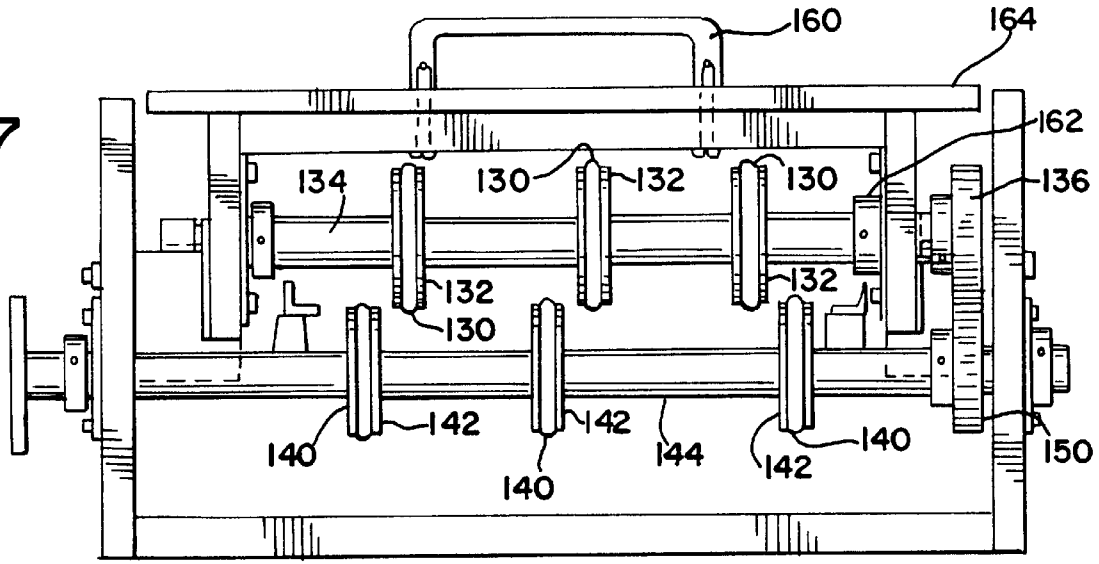
FIG. 7 is an end view of the improved access accumulator showing alignment blocks and latches and relationship of top transport belts to lower transports belts.

Referring to FIGS. 6 and 7, the sequenced forms enter the improved access accumulator 34. Upper belts 130 driven by upper pulleys 132 driven by upper shaft 134 are driven by way of upper drive shaft drive gear train 136. Lower belts 140 pulleys 142 by way of lower drive shaft 144 via lower drive pulley 146 transported to final stacking area 148. Since this improved access accumulator allows for more than one single sheet of paper Do to pass into the improved access accumulator 34 at one time, latches 150 are spring loaded to allow upper transport assembly 152 to adjust it-self up and down depending on the thickness of the paper stack. A left hand and right hand alignment block 154 are provided for adjustment of upper transport assembly as it relates to the lower drive shaft 144 and its respective parts. As shown in FIG. 6A, the upper drive gear 136 and lower drive gear 150 are separated when the upper transport assembly 152 is lifted, then remesh as in FIG. 7, when upper transport assembly 152 is set back in place.

The alignment blocks are adjusted via screws 158 for lateral and horizontal adjustments. A handle 160 is provided to assist in lifting the upper transport assembly 152 Bearings 162 are sealed, self-aligning clamping style. Similar bearings, sized for the greater loads on the shafts on the register 30. A shield 164 preferably of a strong plastic such as Lexan is provided for cleanliness, operational improvement and safety reasons.

Referring to FIGS. 1, 2–3, 11 and 12 the register 30 has improvements over the prior art register table. From cutter 14 the two-up forms enter the register 30. Two individually controllable channels 48 and 50 are provided. Upper belts 44 are driven by upper pulleys 46 which are themselves driven by upper shafts 234.

Lower belts 40 are moved by pulleys 42, themselves driven by lower drive shaft 244 via lower drive pulley 246. In this way forms 24 and 26 in each channel 48, 50 are transported to final stacking areas 56, 58. Shafts 234, 244 are driven by way of drive shaft gear train 236.

Injecting of forms 24, 26 from stacking area 56, 58 is controlled by independently clutched output rollers 64 and output rollers 66 for the separate channels 48 and 50. Each set of output rollers 64 and 66 has its own respective clutch and brake assembly 68 and 70. Effectively these disengage from gear train 236 so that forms 24, 26 remain in areas 56, 58 until release for injection into sequencer merger 32 is calculated to be called for. To this end, assemblies 68 and 70 are preferably computer controlled for such factors as optically read codes, form length, time, number of pages per set and set printing format so that all the subsequent steps are performed in proper order. In particular, the controlled assemblies 68 and 70 can be used for all the aforementioned combinations of North/South, West/East and East/West printing, in whatever multiples needed.

Center bearing assembly 72 allows independent adjustments and separation of drives for channels 48 and 50. The register is supported by side plates 74, 76 which enable the mechanism to be mounted in and demounted from housing 78 and provide the requisite support for crossmembers 79.

For both the accumulator 34 and register 30 it has also been determined that the respective lower belts 140, 40, pulleys 142, 42 and shafts 144, 44 may be substituted by metal rods or other suitable minimal friction page supporting members. A hard, chemical resistant rod such as stainless steel is preferred, but plated or other alloys may be used or other hard, durable, low friction materials, such as an appropriately finished ceramic. A like arrangement could be adapted to the register 30. An advantage to this is the resistance of the metal or other rods to smearing of ink. There is some tendency to smear ink on printed pages, particularly when pages are printed on two sides, when the belt arrangements are used. By eliminating the belts, this problem could be reduced.

Figure 2:
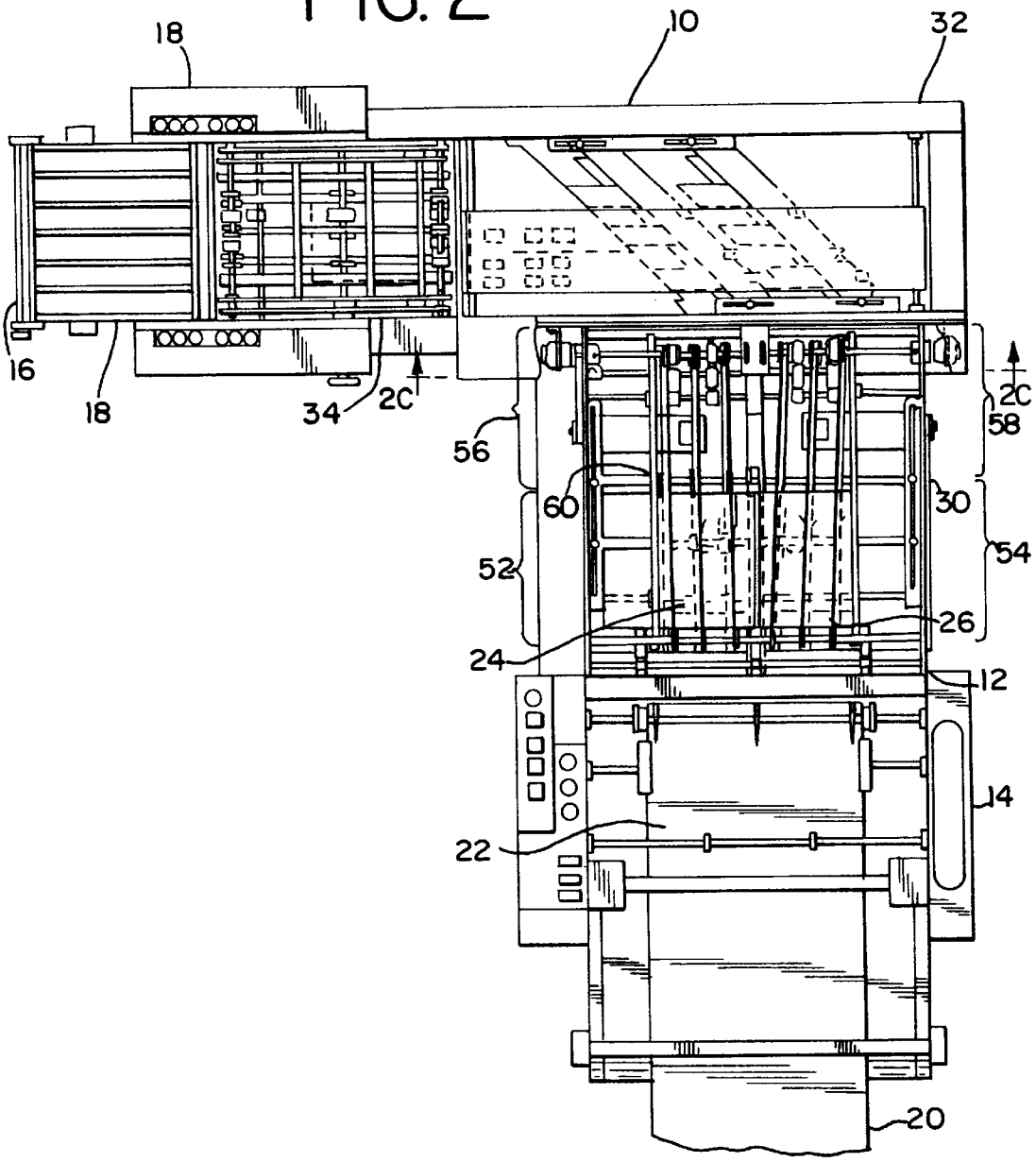
FIG. 2 is a plan view showing the general layout of the apparatus used in practicing the method.
Figure 2C:
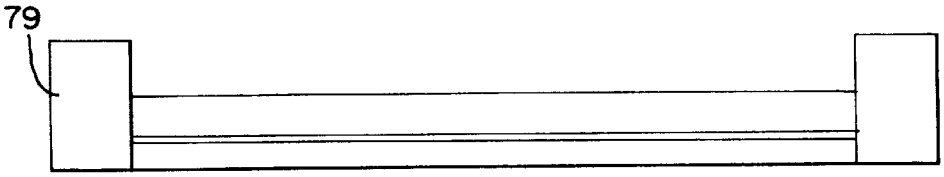
FIG. 2C is a sectional view through line 2 in FIG. 2 of the register showing the register plate and aperture therein.
Figure 2A:
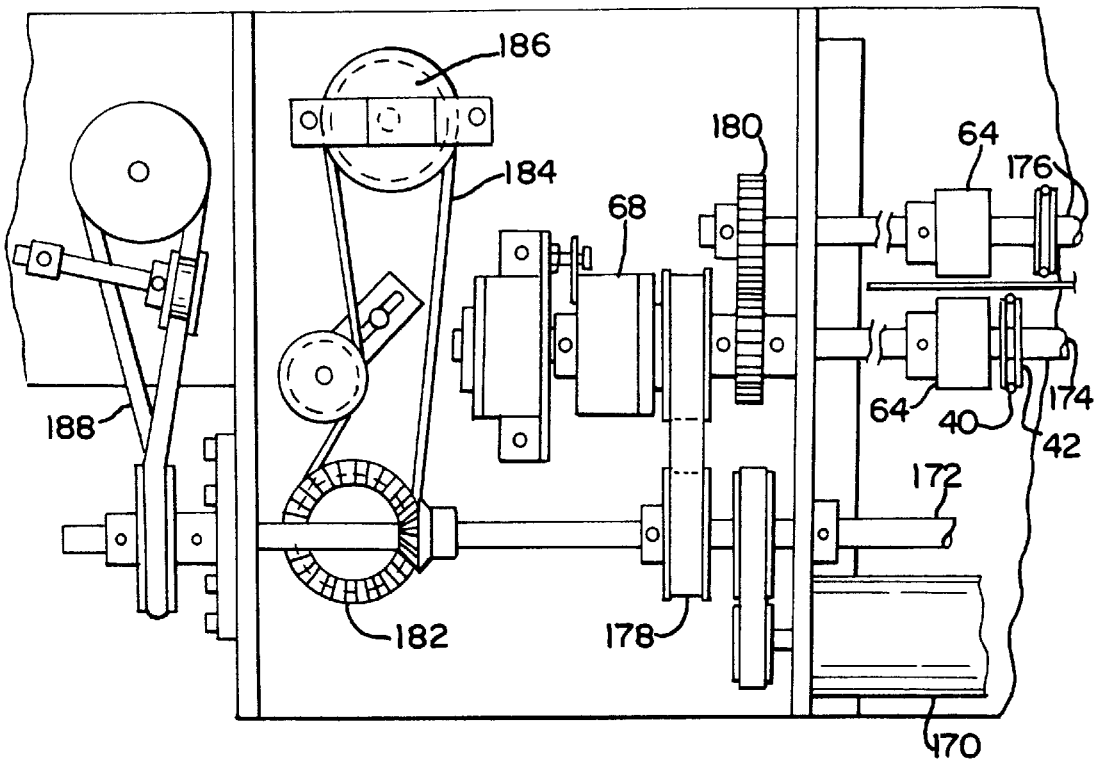
FIG. 2A is a partial elevational view showing the left side drive mechanism of the dual registering stacking interface.
Figure 2B:
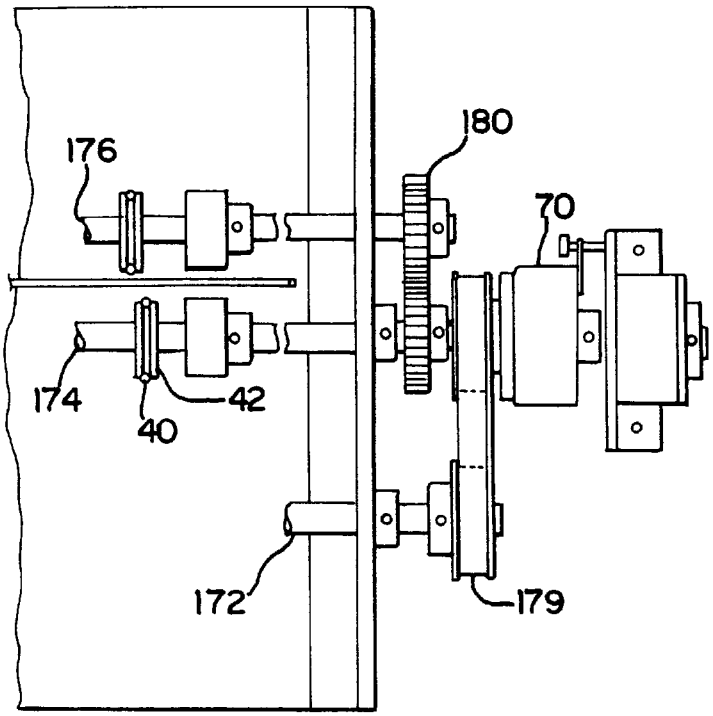
FIG. 2B is a partial elevational view showing the right side drive mechanism of the dual registering stacking interface.

The drive arrangement for all three components, register 30, sequencer 32 and improved access accumulator 34 is shown in FIG. 2A and the clutch 70 for the register 30 in FIG. 2B. Motor 170 drives main drive shaft 172 which drives register shafts 174, 176 through timing belt 178 driving clutch 68 which selectively engages shaft 172 gear train 180. Shaft 172 also drives gear train 182 which through belt 184 drives sequencer clutch 186. The left end of shaft 172 also drives improved access accumulator 34. A belt drive 188 is preferred. However, a gear drive arrangement like that described in connection with the register drive would provide superior control and is expected to eliminate streaking on forms caused by the belt movement used with the belt drive 188. At the right side, in FIG. 2B, corresponding clutch 70 operates drive belt 179 and gear train 181 to maximize the precision of the timing of the belts to reduce the effect of torsion on the shafts 176, 174.

Figures 8, 9, 10, 13, 14:
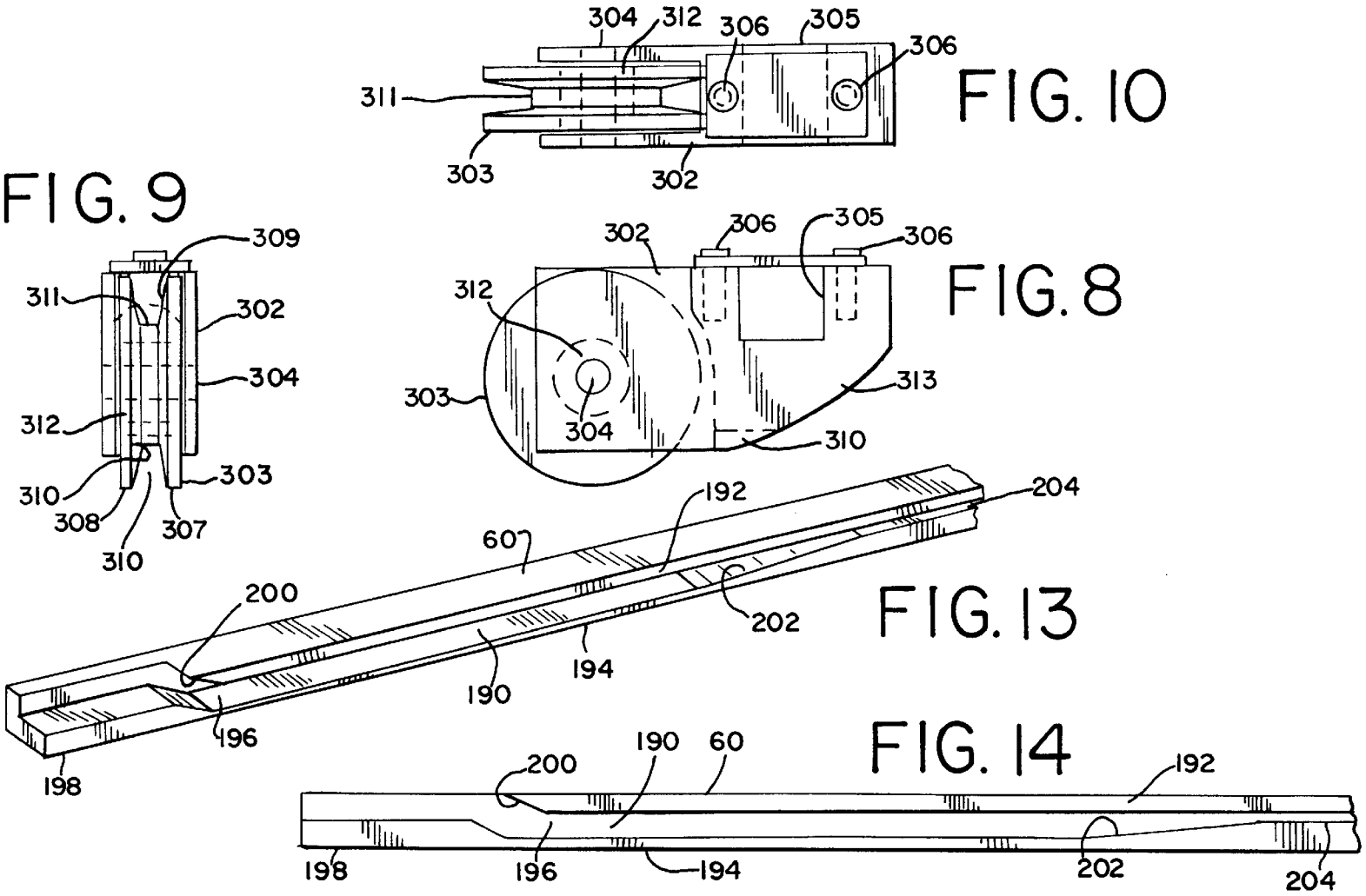
FIG. 8 is a elevation of a low friction paper guide.
FIG. 9 is a front elevation of a low friction paper guide.
FIG. 10 is a bottom plan view of a low friction paper guide.
FIG. 13 is a perspective view of an improved rail for the dual registering stacking interface.
FIG. 14 is a right side elevational view of an improved rail for the dual registering stacking interface.
Figure 11:
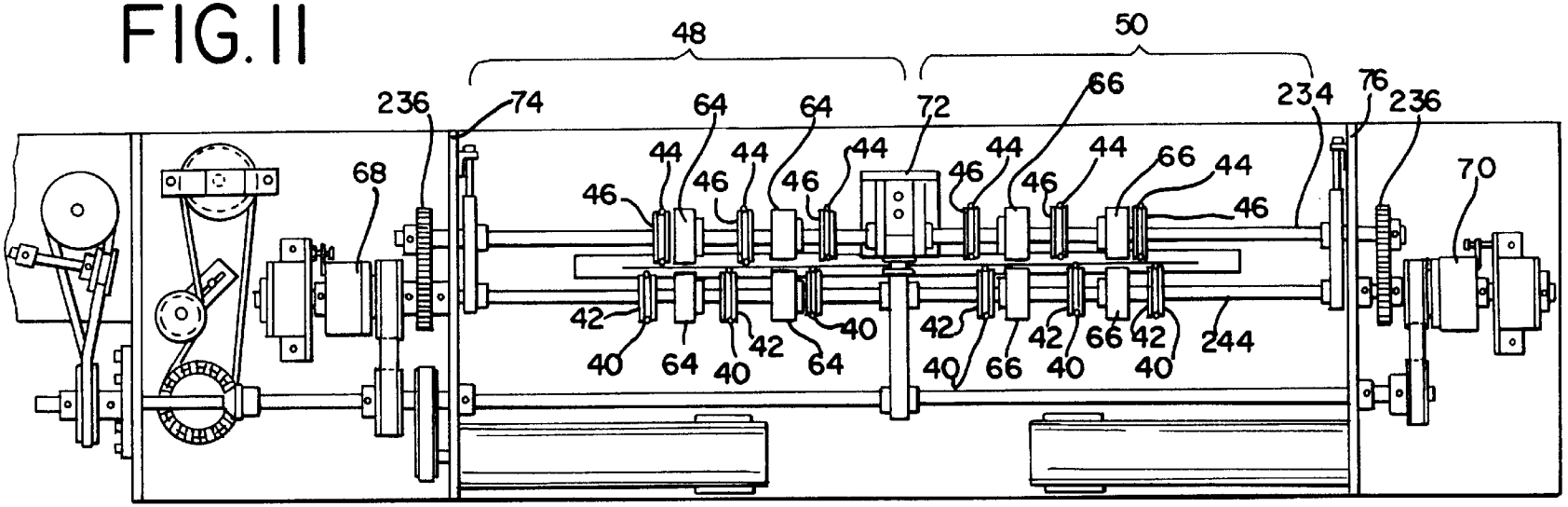
FIG. 11 is a front elevational view of the dual registering stacking interface.
Figure 12:
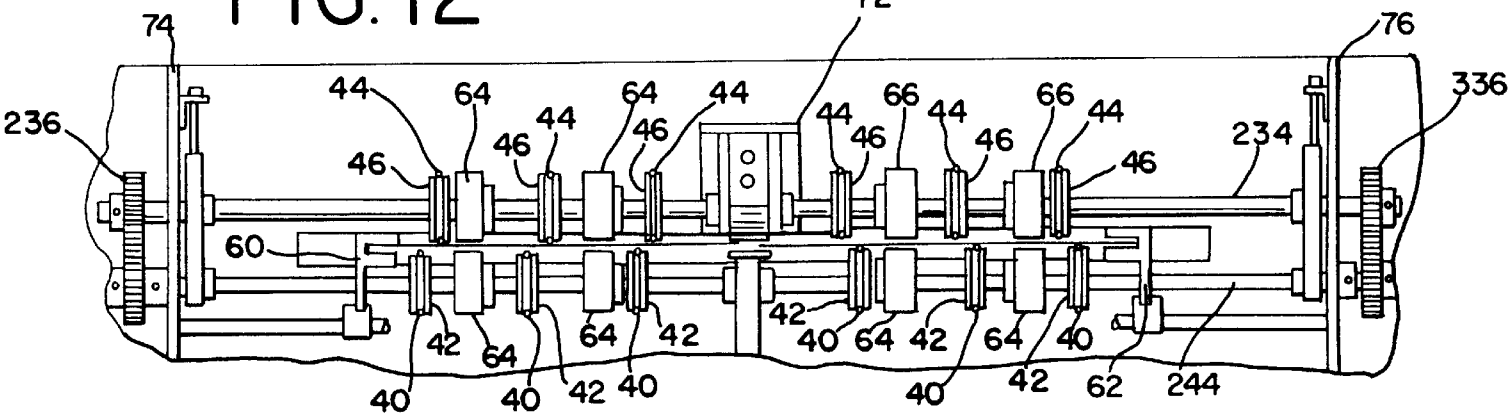
FIG. 12 is a rear elevational view of the dual registering stacking interface.
Figure 15:
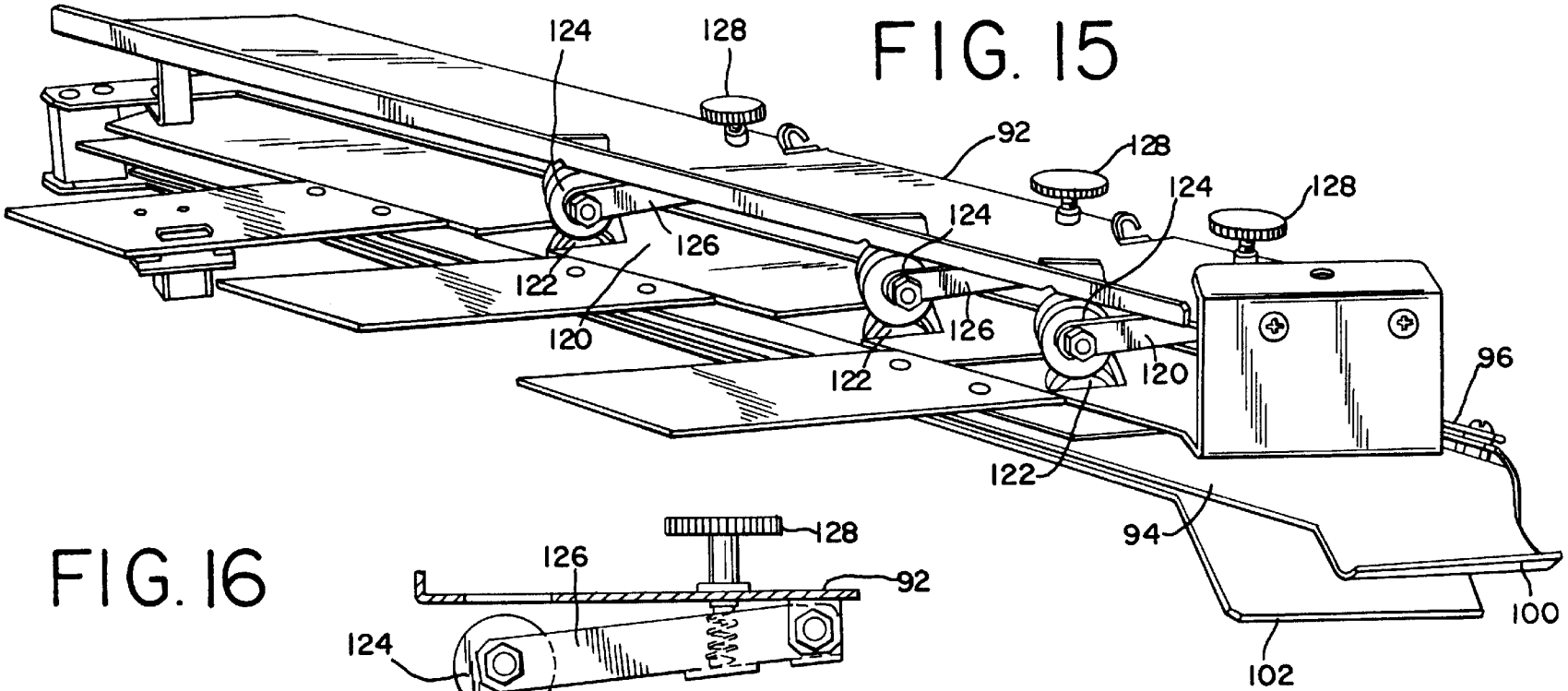
FIG. 15 is a perspective view of a tube assembly.
Figure 16:
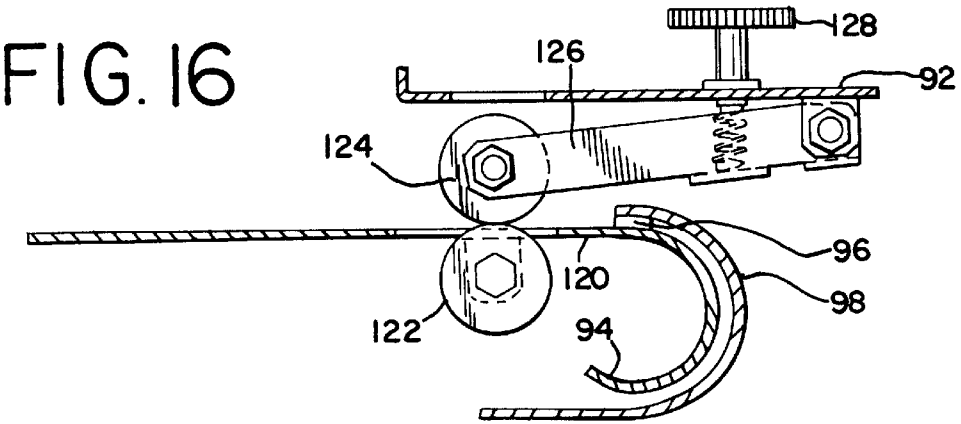
FIG. 16 is a cross-sectional view of a tube assembly.

FIG. 13 and FIG. 14 show an improved side guide 60. Side guide 62 is a mirror image of guide 60. Side guide 60 has a side web 190 interconnecting top flange 192 and bottom flange 194 so as to define paper slot 196 therebetween. It should be understood that the terms "top" and "bottom" and "over" as used herein refer to the orientation as shown in the drawings. In some situations, depending on whether forms are to be stacked one on top of the other, or with the next page below the previous page, it may be desirable to invert components such as side guides 60, 62 and the low friction paper guides described herein.

Form 24 enters the side guide 60 by passing over shoulder 198 and is then displaced by ramp 200 to assure smooth and controlled entry into slot 196. As the paper passes over the various rollers and the paper guide described below, slot 196 provides enlargement for vertical displacement of the position of the page. Interior ramp 202 then returns the paper to the exit portion or exitway 204 of slot 196. Top flange 192 captures form 24 so that as it is vertically deflected it nevertheless remains in slot 196 thereby minimizing wrinkles, jams and other unwanted movement of form 24 as is present in the prior art. The same performance occurs simultaneously at the other side of register 30 with side guide 62 and form 26.

As seen in FIGS. 6B and 8–10, low friction paper guide 301 is adapted to be usable in both the register and the improved access accumulator. Block 302 rotatably carries roller or sheave 303 on axle 304. Mounting recess 305 is provided in the top of block 302 for mounting to square section bar stock or the like in the unit in which it is to be mounted. Screw hole 306 is also adapted to aid in mounting and adjustment.

Sheave 303 has flanges 307 and 308 defining a groove 309 therebetween for receiving a selected drive belt. The drive belt also passes through slot 310 in the bottom of block 302. Flanges 307, 308 extend outwardly from a hub portion 311 thus the hub 311 defines the bottom of groove and the flanges 307, 308 the sides of the groove. In the preferred embodiment a bushing or bearing 312 is fitted to sheave 303.

Block 302 is formed to have a curved lead in portion 313 that directs form 24, 26 to roller or sheave 303 against the pressure of belt 40 or 44 depending on the upward or downward orientation of block 302. The use of the curved lead in portion 313 and sheave or roller 303 substantially reduces the friction on the form, permitting higher speed and fewer jams. It will also be noted that the free rolling of sheave 303 eliminates any rear stop effect as is used in the prior art.

Figure 17:
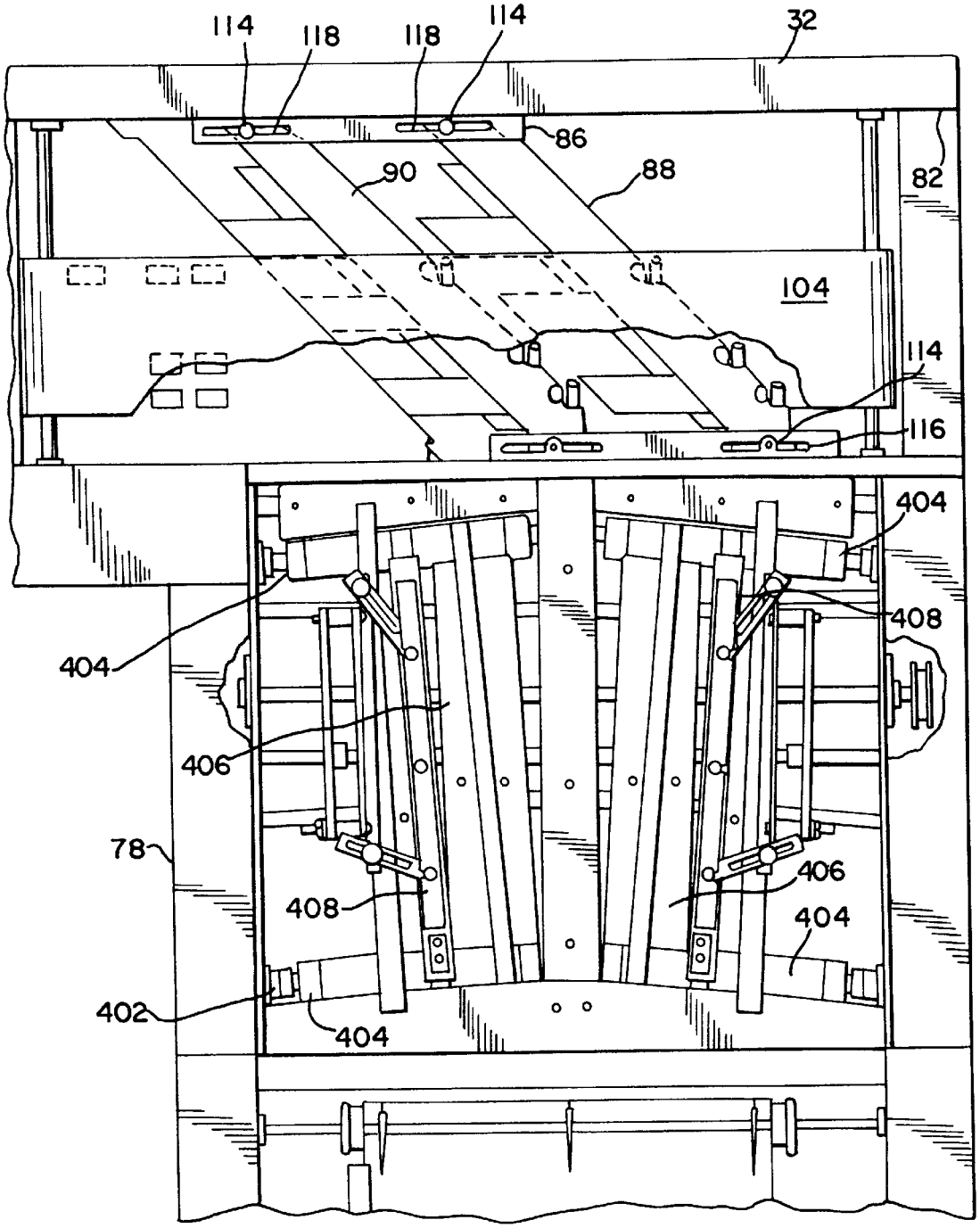
FIG. 17 shows an alternative embodiment using a portion of the mechanism of a prior art register table adapted to be used with the components of the invention.

FIG. 17 shows a different arrangement for injecting forms into sequencer/merger 32 which is a variation on the invention. The housing 78 is used to insure appropriate mating with sequencer/merger 32 to take advantage of the integrated system of the invention. However, prior art register table 402 uses a series of rollers 404 and platens 406 to move forms, having registration members 408 against which forms are registered. Prior art register table 402 is unable to perform a stacking operation, merely separating forms, thus it is unusable for North/South multiple forms. Nevertheless, an advantage to the integrated system of the invention is that it can be used to take advantage of a user's present inventory of even obsolete equipment like the register table 402.

Figure 18:
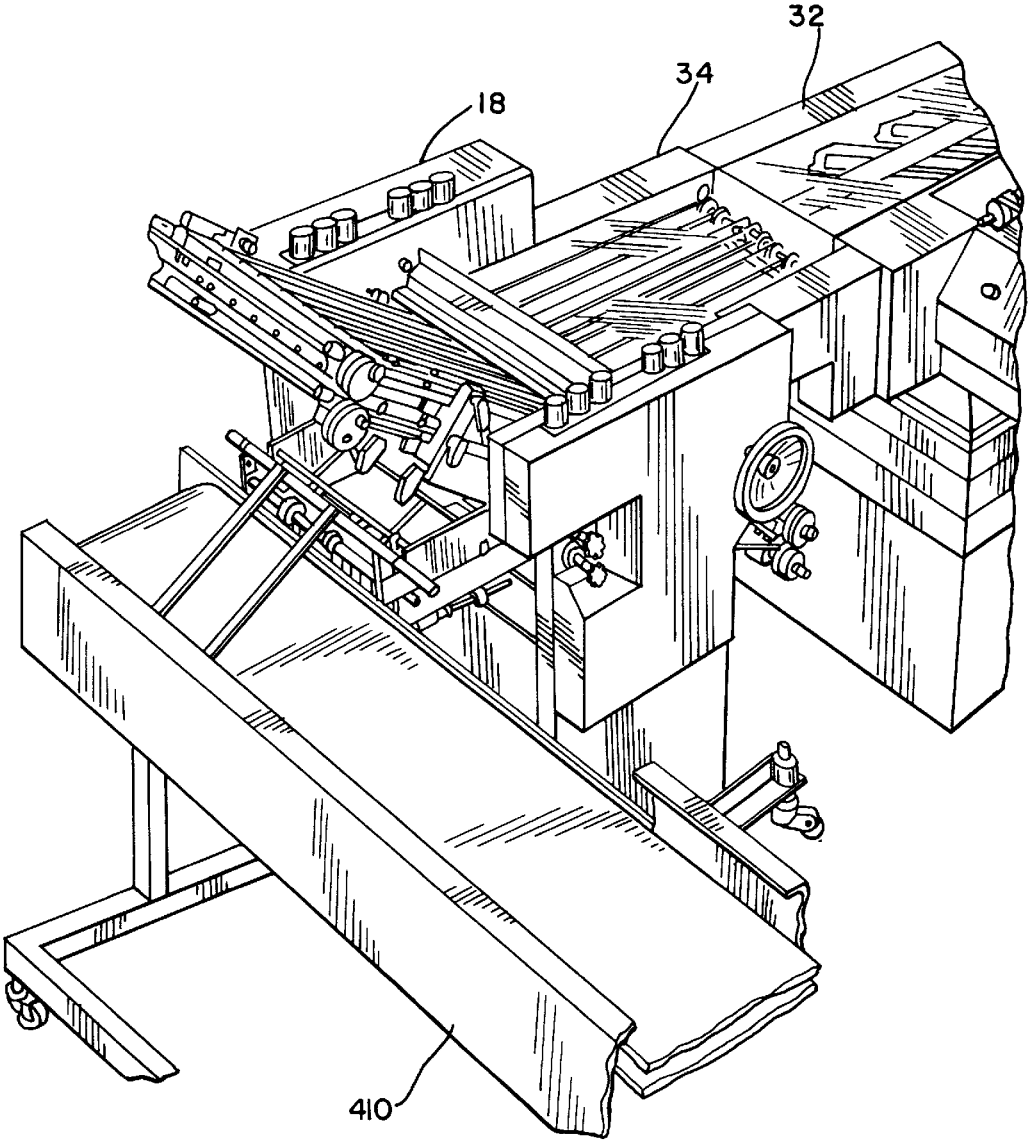
FIG. 18 illustrates the offline use of the invention where it is not connected to a cutter and envelope inserter.

FIG. 18 shows the off-line operation of the invention. Another advantage to the integrated control of register 30, sequencer/merger 32 and improved access accumulator 34 is that unlike prior art devices, the entire system can be disconnected from an inserter machine and used off line. This can be for testing, adjustment, set-up or maintenance, without requiring the operation of the inserter machine. This can also be advantageous for operations with an ancillary device 410 such as a simple conveyor which would enable very rapid separation, collating, processing and folding of materials such as flyers or brochures to be distributed by hand or personally, such as a trade shows, conventions or the like.

While several embodiments have been shown and described with respect to the present invention, it should be understood that the present invention is not limited to these embodiments, but rather is susceptible to numerous changes and modifications as known to those skilled in the art. Therefore, we do not wish to be limited to the detail shown and described herein, and intend to cover all such changes and modifications as are encompassed by the scope of the appended claims.

In accordance with our invention, we claim:

1. An apparatus for processing and stacking printed forms adapted to feed said forms for processing by an inserter comprising:

a dual registering stacking interface receiving continuously fed forms, transversely registering said forms and selectively stacking and transporting said forms to a first output end;

a sequencer merger receiving said forms from said first output end, directing said forms in a selected order and transporting said forms to a second output end, said sequencer merger adaptable to process said forms as a stack of forms;

an improved access accumulator having upper and lower transport belts that, in a first position are in operative relation to one another to accumulate forms into a single set and transport said forms to a third output end and in a second position separating said belts for servicing;

said improved access accumulator transporting said forms to said third output end from which said forms are ejected for use or further processing.

2. The invention according to claim 1 and said apparatus being operatively connected to an optical reading device adapted to read indicia affixed on said forms;

said apparatus being controlled by a computer;

said computer and apparatus being operable independent of an inserter and being operable in coordination with an inserter for off line or on line operation.

3. The invention according to claim 2 and each of said dual registering stacking interface, sequencer merger and improved access accumulator sharing a common supplier of motive power.

4. An improved sequencer merger tube for directing forms in a linear direction from one device to another device, said tube having an inner tube and an outer tube for directing forms therebetween;

said inner tube having a top inner tube entry flange;

said outer tube having a bottom outer tube entry flange;

whereby said flanges coact to direct said forms to a gap between said inner and outer tubes adapted to pass multiple forms therethrough at substantially the same time.

5. The invention according to claim 4 and said sequencer merger tube has tension adjustable spring loaded rollers associated with said outer tube, said rollers being adjustable to control form movement in said linear direction and to control form skew relative to said linear direction.

6. The invention according to claim 5 and one of said rollers being located near the position of form entry to the tube.

7. An accumulator for receiving and stacking forms having improved access comprising:

a top opening portion having a top set of transport belts and pulleys driven by a first gear;

a stationary bottom portion having a bottom set of transport belts and pulleys operatively connected to a second gear;

said first gear being driven by said second gear when said top is in a closed position and said gears disengaging when said top is in an open position.

8. The invention according to claim 7 and said top being retained in said closed position by a spring latch whereby said spring latch takes up clearance needed by the stacking of multiple forms in said accumulator.

9. A form transporting and stacking apparatus comprising:

a stacking area substantially parallel to and coplanar with a transport path;

a low friction guide for vertically displacing a plurality of forms from said transport path so that said forms are arranged in a stack;

a clutch and brake assembly for releasing said stack for use or further processing;

wherein said low friction guide is non-planar and provides no resistance to rebounding movement of forms that have passed said guide.

10. The invention according to claim 9 and said apparatus is of the transport belt type.

11. The invention according to claim 9 and said apparatus uses a plurality of minimal friction form supporting members of a hard, chemical resistant cylindrical shape.

12. A method of processing paper forms comprising the steps of:

feeding said forms in side by side orientation to a processing apparatus;

optically printed indicia on said forms and programmably determining subsequent steps based on said indicia;

outwardly justifying said side by side forms;

selectively passing said forms to a subsequent step or stacking said forms with related forms, depending on the reading of said indicia;

releasing said passed forms or stacked forms in related order to be sequenced and merged;

sequencing and merging said forms;

accumulating said forms and finally feeding said forms out of said processing apparatus.

13. The invention according to claim 12 and said selective passing or stacking step being performed by reading said indicia and determining if related forms have been printed in the formats of North/South, West/East or East/West;

stacking related forms in said passing or stacking step if said forms were printed in a North/South format;

passing said forms in said passing or stacking step if said forms were printed in a West/East or East/West format;

stacking said forms in said accumulating step if said forms were printed in a West/East or East/West format.

14. The invention according to claim 12 and said passing or stacking step being performed by a dual registering stacking interface which receives continuously fed forms, transversely registers said forms and selectively passes or stacks said forms to a first output end.

15. The invention according to claim 12 and said sequencing merging step being performed by a sequencer merger receiving said forms from said first output end, directing said forms in a selected order and transporting said forms to a second output end, said sequencer merger adaptable to process said forms as a stack of forms.

16. The invention according to claim 12 and said accumulating step being performed by an improved access accumulator having upper and lower transport belts that, in a first position are in operative relation to one another to accumulate forms into a single set and transport said forms to a third output end and in a second position separating said belts for servicing;

said improved access accumulator transporting said forms to a third output end from which said forms are ejected for use or further processing.

* * * * *

UNITED STATES PATENT AND TRADEMARK OFFICE

CERTIFICATE OF CORRECTION

Figure 24:
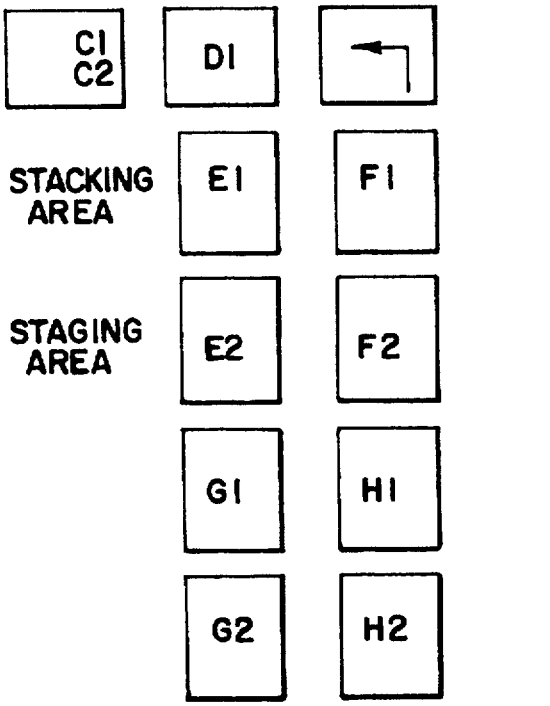

PATENT NO. : 5,887,864
DATED : March 30, 1999
INVENTOR(S) : Kenneth A. Stevens and Douglas J. Keller It is certified that error appears in the above-identified patent and that said Letters Patent is hereby corrected as shown below:

Column 7,
Lines 44-45, delete "FIG. 6C is a sectional view of the top improved access accumulator.";

Column 8,
immediately after line 12, please add the following paragraph:

--Figure 24 schematically illustrates North/South mixed multiple printed documents at a sixth stage. --;

Line 57, delete "58,60" and substitute therefor --56,58--;
Line 60, delete "23" and substitute therefor --24--.

Column 9,
Line 7, delete "23" and substitute therefor --24--;
Line 41, delete "23" and susbstitute therefor --24--;
Line 43, delete "in" and substitute therefor --and is--.
Line 45, delete "22" and substitute therefor --23--.

Column 10,
Last paragraph, at the 5th line, after "140" insert --driven by lower--; after "142" add --are driven--; delete "way of"; and after "144" insert --.--; and delete "via lower";
6th line delete "drive pulley 146" and substitute therefor --Thereby the paper is--; and 8th line, delete "Do".

UNITED STATES PATENT AND TRADEMARK OFFICE

CERTIFICATE OF CORRECTION

Figure 3:
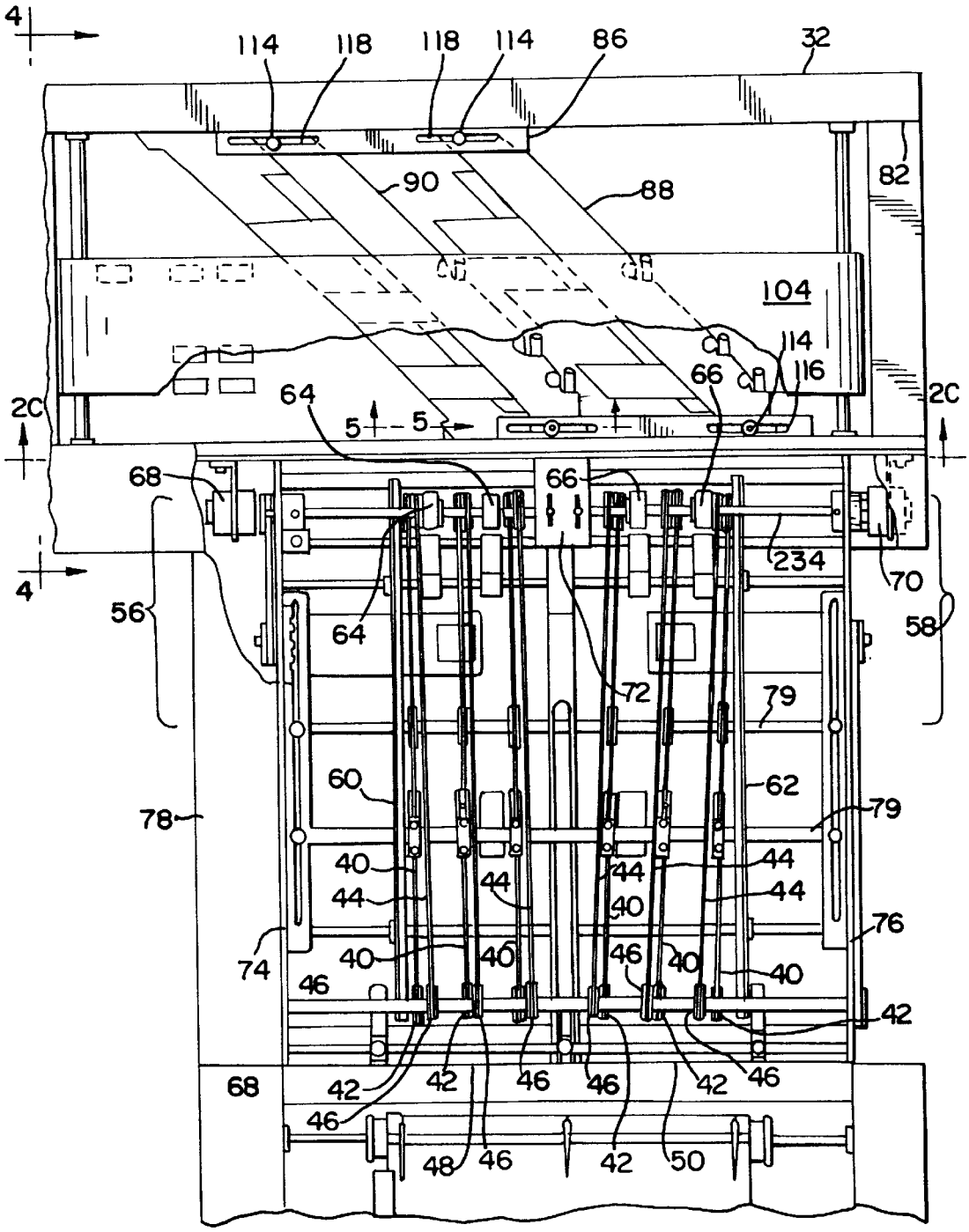
FIG. 3 is a plan view of the sequencer merger and dual registering stacking interface with the sequencer belt partially cutaway.
Figure 4:
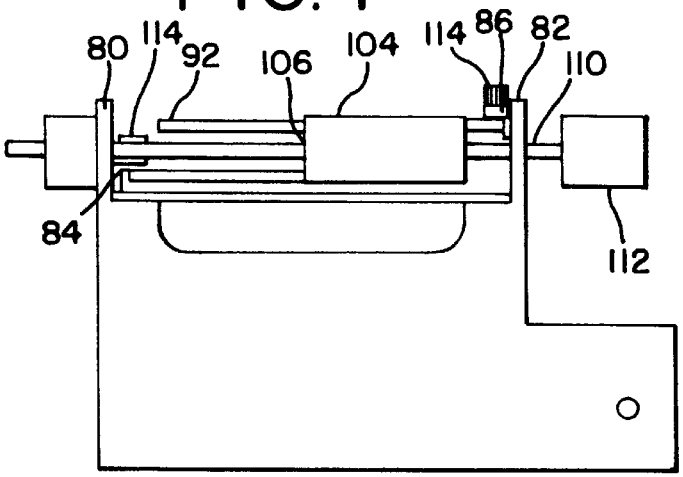
FIG. 4 is a rear elevational view of the sequencer meager.
Figure 5:
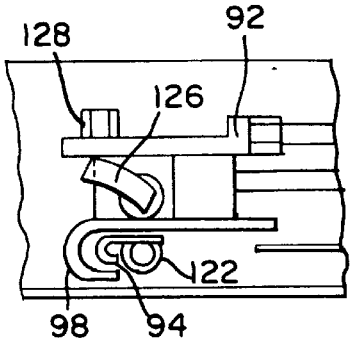
FIG. 5 is a sectional view of the sequencer merger.

PATENT NO. : 5,887,864
DATED : March 30, 1999
INVENTOR(S) : Kenneth A. Stevens and Douglas J. Keller It is certified that error appears in the above-identified patent and that said Letters Patent is hereby corrected as shown below:

IN THE DRAWINGS:

Please replace drawing Figures 3, 21 and 22 with the enclosed correct drawing Figures 3, 21 and 22. Please add drawing Figure 24 also attached hereto.

Signed and Sealed this

Nineteenth Day of June, 2001

Nicholas P. Godici

*Attest:*

*Attesting Officer*

NICHOLAS P. GODICI
*Acting Director of the United States Patent and Trademark Office*